US007416058B2

(12) United States Patent
Marterer

(10) Patent No.: US 7,416,058 B2
(45) Date of Patent: Aug. 26, 2008

(54) METHOD OF OPERATING AN ELEVATOR INSTALLATION PROVIDING AT LEAST ONE OPTIONAL FUNCTION, AN ELEVATOR CONTROL AND AN ELEVATOR INSTALLATION THEREFOR

(75) Inventor: Christian Marterer, Ludwigsburg (DE)

(73) Assignee: Inventio AG, Hergiswil NW (CH)

( * ) Notice: Subject to any disclaimer, the term of this patent is extended or adjusted under 35 U.S.C. 154(b) by 570 days.

(21) Appl. No.: 10/996,921

(22) Filed: Nov. 24, 2004

(65) Prior Publication Data

US 2005/0155821 A1 Jul. 21, 2005

(30) Foreign Application Priority Data

Nov. 25, 2003 (EP) ..... 03405842

(51) Int. Cl.
*B66B 1/34* (2006.01)

(52) U.S. Cl. ..... 187/391; 187/247

(58) Field of Classification Search ..... 187/247, 187/391–396, 380, 382, 384
See application file for complete search history.

(56) References Cited

U.S. PATENT DOCUMENTS 4,410,959 A * 10/1983 Tajima et al. ..... 187/247
5,200,583 A * 4/1993 Kupersmith et al. ..... 187/384
5,554,832 A * 9/1996 Lumme et al. ..... 187/380
6,425,460 B2 * 7/2002 Schuster ..... 187/247
6,615,175 B1 * 9/2003 Gazdzinski ..... 704/275
6,847,292 B2 * 1/2005 Nlabu ..... 340/539.1

FOREIGN PATENT DOCUMENTS

| | | |
|---|---|---|
| EP | 0 523 601 | 1/1993 |
| EP | 0 631 965 | 1/1995 |
| EP | 0 857 684 | 8/1998 |
| WO | WO 02/064479 | 8/2002 |

* cited by examiner

*Primary Examiner*—Jonathan Salata
(74) *Attorney, Agent, or Firm*—Fraser Clemens Martin & Miller LLC; William J. Clemens

(57) ABSTRACT

A method of operating an elevator installation having an elevator control with a plurality of functions ($F_1, \ldots F_{n+m}$) for controlling the elevator installation, wherein the plurality of functions comprises at least one optional function ($F_{n+1}, \ldots F_{n+m}$) which is activatable at the time of configuring of the elevator control and can be made available by an activation for control during the operation of the elevator installation. After the activation, a deactivation of the optional function ($F_{n+1}, \ldots F_{n+m}$) takes place automatically in accordance with a predetermined criterion, wherein the optional function after deactivation is no longer available for control of the elevator installation in operation.

36 Claims, 2 Drawing Sheets

METHOD OF OPERATING AN ELEVATOR INSTALLATION PROVIDING AT LEAST ONE OPTIONAL FUNCTION, AN ELEVATOR CONTROL AND AN ELEVATOR INSTALLATION THEREFOR

BACKGROUND OF THE INVENTION

The present invention relates to a method of operating an elevator installation, which comprises an elevator control with a plurality of functions for control of the elevator installation, and to an elevator control.

The elevator control of an elevator installation usually comprises implementations of a plurality of functions. As a rule, more functions are implemented in the elevator control of an elevator installation than are actually available for the elevator control for controlling during operation of the elevator installation. Which of the implemented functions during operation of the elevator installation are actually available for controlling or which of the implemented functions shall not be available for controlling during operation of the elevator installation is usually established by a configuring of the elevator control.

By configuring of an elevator control of an elevator installation there can be understood every measure establishing one or more characteristics which the elevator control is to have with respect to controlling of the elevator installation during operation of the elevator installation. This embraces establishing actions and reactions which are controllable by the elevator control and relate to operation of the elevator installation.

The configuring enables consideration of specific operating parameters of the elevator installation and establishes the system behavior which the elevator control is to exhibit during operation of the elevator installation. Configuring usually takes place on one occasion prior to placing an elevator installation into operation. It can in a given case also be repeated at a later point in time, for example in order to change the system behavior of the elevator control. The latter can be relevant if the configuration of the elevator installation and/or of the elevator control has to be changed. This concerns, for example, the installation or demounting of components which in operation of the elevator installation are subject to or shall be subject to the control of the elevator control, or the installing (implementing) or deinstallation of program modules which are suitable for controlling the elevator installation and which—when installed—represent a realization of control options of the elevator control. So that a change of that kind in the configuration is effective in operation of the elevator installation, a renewed configuring of the elevator control is usually carried out in order to adapt the elevator control to the changed situation. In this case configuring has to comprise at least such measures which specify the required changes in the system behavior of the elevator control.

The system behavior of an installed and already configured elevator control of an elevator installation can be subsequently changed within a certain scope even when the implementation of functions in the elevator control remains unchanged. For this purpose it is merely necessary to undertake a renewed configuring of the elevator control in accordance with a changed specification of the elevator installation. In this manner the elevator control can be appropriately adapted to changed requirements of the system behavior, for example after modernization of the elevator installation, without constructional changes in the elevator control itself being necessary.

A method and device for installing or operating an elevator control is disclosed in European patent document EP 0 857 684 A1. The configuring of the elevator control of an elevator installation takes place, after installation of the elevator installation, with the help of a memory card which contains in a memory element all control data necessary for operating the elevator installation, i.e. particularly programs and/or data for controlling the elevator installation and for configuring the elevator control. The memory card is inserted into the elevator control. Specific special functions and options, for example operation for handicapped persons, operation for VIPs, an energy-saving mode or a fire protection system, are selectably activated by the memory card and are thus available to the control during operation of the elevator installation. If after placing of the elevator installation in operation other control options for operation of the elevator installation are to be made available, the memory card then has to be replaced by another memory card with a memory element which contains the control data suitable for activation of the desired control options. For every desired change, a person has to visit the elevator installation each time in order to insert the new memory card into the elevator control. This is costly when changes have to be undertaken frequently or even routinely, for example, when specific control options are to be made available merely for a limited period of time for controlling during operation of the installation or when operation of elevator controls is carried out on the basis of a contract of limited term or maintenance of elevator installations takes place on the basis of a maintenance contract of limited term.

The present invention has the advantage of creating a method of operating an elevator installation, and of creating an elevator control, in such a manner that a selective change in control operations after placing the elevator installation in operation is possible at a low cost.

SUMMARY OF THE INVENTION

In the following it is assumed that the elevator control comprises an implementation of a plurality of functions.

By a function there is understood in the following every measure or group of measures which can be executed by the elevator control in order to control the elevator installation. In that case the expression "implementation of a function" shall embrace the devices (hardware) and/or program modules (software) contributing to realization of the function.

The implemented functions can be divided into two groups with respect to their relevance for operation of the elevator installation: standard functions and optional functions.

As a standard function there is understood an implemented function which is to be made available for every possible mode of operation of the elevator installation.

As an optional function there is understood an implemented function which does not have to be available for every possible form of operation of the elevator installation. Depending on the respective interests of the operator of the elevator installation there can be taken into consideration in configuring of the elevator control whether or not such a function shall be made available in the operation of the elevator installation.

An implemented function is termed activated when it is available for control in the operation of the elevator installation.

An implemented function is termed an activatable function when in the case of configuring there can be involved a determination whether or not the functions shall be available for control in operation of the elevator installation. By activation of a function there is understood a measure which establishes that the function is available for control in the operation of the elevator installation.

The invention proceeds from the fact that at least one of the optional functions or also several operational functions is or are activated in the case of configuring of the elevator control. Through the activation this optional function or these optional functions is or are initially available for control in operation of the elevator installation.

In accordance with the present invention it is provided that the elevator control comprises a device for automatic deactivation of optional functions. By deactivation of an optional function there is understood that the function was activated at the time of configuring the elevator control, but after the deactivation is no longer available for control in operation of a elevator installation. According to the present invention at least one of the initially activated optional functions is automatically deactivated and thus is available for control in operation only for a limited period of time. The device for automatic deactivation of optional functions accordingly allows a check of the time in which an optional function is available in operation of the elevator installation and can be taken advantage of by a user of the elevator installation. A selective change in control options after placing of the elevator installation into operation is achieved by the deactivation. This change is not connected with any further effort for personnel, since it is carried out automatically.

Apart from establishing which of the functions implemented in the elevator control of an elevator installation are to be available for controlling in the operation of the elevator installation, still further determinations can, in a given case, be involved in the configuring. Individual functions can depend on, for example, one or more parameters which determine the execution of the respective function. Such parameters can be established during the configuring. For example, a function "open car and/or shaft doors" can be more precisely specified by determinations how quickly the doors are to be opened or closed and/or how long doors are to be open before an automatic system for closing the doors is started. Moreover, it can be necessary for several functions to be operatively interconnected in a control process in order to control specific complex processes during operation of the elevator installation, for example in such a manner that several functions can be executed simultaneously or in succession in a specific sequence in time. In the latter case a series of functions can be implemented in such a manner that several variants for co-operation of several functions are possible. Through configuring of the elevator control it can now be established which of the possible variants are to be realized and shall be available for controlling in operation of the elevator installation. In this case it can be established in the configuring of the elevator control: (i) which functions are to be operatively interconnected in the case of a control process; and in a given case (ii) according to which rules the functions are to be used. For example, there can be implemented in an elevator control several kinds of control for the handling of calls (car call and/or floor call), inter alia the kinds of control of pushbutton control, collective downward control, collective/selective control or group control. These kinds of control are distinguished principally with respect to the mode and manner how the elevator control reacts to several incoming calls, for example with respect to the registration of arriving calls and/or the sequence of working down several input calls. Which of these kinds of control are to be used in the operation of the elevator installation is established in the configuring of the elevator control.

The present invention makes it possible, for example, for a provider of elevator controls to make available to a customer specific control operations as "servicing work for a time", for example within the scope of a rental or lease contract. Thus, specific optional functions can be activated at the time of configuring the elevator control, for example optional functions which serve for improvement of travel comfort. The device for automatic deactivation of optional functions can be so arranged that a deactivation takes place when a predetermined criterion is fulfilled, for example when a specific time period has elapsed or when a specific event has occurred a predetermined number of times. Thus, the provider can conclude agreements with the customer about duration and conditions of utilization of optional functions and already on configuring the elevator installation arrange the device for automatic deactivation in correspondence with the agreements. The provider can in that case so arrange the device for automatic deactivation that the optional functions are activated only for as long as they have to be available for control of the elevator installation in accordance with the agreements with the customer. Subsequently a deactivation of the optional functions takes place—as pre-programmed—automatically. If the customer decides that it is desired to use the optional functions for a longer period of time, then an activation of the desired optional functions for a further period of use can be undertaken in good time. If the customer does not keep to the agreement—for example, the customer does not pay the agreed fees for the utilization of the servicing work of the provider—then the provider does not have to undertake anything further: the utilization of the optional functions automatically ends at a point in time and under conditions which the provider has itself determined in conjunction with the activation of the functions.

The present invention makes it possible for, for example, a provider of services in the field of maintenance of elevator installations to make agreements with a customer about maintenance of a elevator installation during a maintenance period limited in time. In this case the provider can, for example, at the time of configuring of the elevator control activate specific optional functions which enable detection and/or diagnosis of operational data and/or analysis of fault reports of the elevator control. In this case the provider can so arrange the device for deactivation of the optional function that the activated optional functions are deactivated at a point in time determined by the provider, wherein the deactivation takes place automatically without further intervention of the provider. If a renewed activation takes place, then the optional functions are no longer available after the deactivation. This use is of interest for the provider particularly when the optional functions deliver results which go beyond a customary extent, for example an extent determined by a law or by a standard. After the deactivation the optional functions are no longer usable for maintenance purposes. The automatic deactivation offers the provider protection against misuse by another provider which is then not in a position of offering a comparable service. After the deactivation there remain available for detection and/or diagnosis of operational data and/or analysis of fault reports only standard functions which merely supply results within the scope determined by a law or a standard.

One form of embodiment of the elevator control according to the invention comprises an interface by way of which activation information is transmissible, and a processor for evaluation of the activation information. The activation information contains the essential data needed for control of the activation and/or deactivation of optional functions. The activation information can comprise, for example, a code or data and can, for example, be manually input (for example, by way of a keyboard), transmissible by electronic means or stored on a data carrier and readable from this data carrier.

The activation takes place under the control of the elevator control. After communication of activation information by way of the interface of the elevator control the activation information is evaluated by the processor of the elevator control in accordance with a predetermined criterion, called evaluation criterion in the following. Depending on whether the activation information fulfils the evaluation criterion, the processor can accept the activation information as valid or reject it as invalid. If valid activation information is present, then depending on a result of the evaluation in a given case the activation of one or several optional functions can be arranged to be carried out. The evaluation can comprise several steps. The activation information can comprise, for example, the information which optional functions are to be activated and/or when the activation of an optional function and/or when or in accordance with which criterion the activation of an optional function is to take place. The activation information can, in addition, contain safety features which can protect against possible misuse. For example, the activation information can contain data which uniquely identify the elevator control or the elevator installation. In this manner it can be ensured that a specific activation information is valid only for one elevator control or one elevator installation and is rejected as invalid by another elevator control. Moreover, the activation information can contain information which is given only to known persons to be authorized for transmission of activation information by way of the interface. This information can comprise an identification of the person concerned. The activation information can also contain, for example, information which identifies each individual transmission of activation information as such. This information—called transmission identification in the following—can, for example, be valid only for a single transmission or for a limited number of transmissions. On the basis of the transmission identification, successive transmissions of activation information can be distinguished by the processor. The processor can accept activation information as valid only when, for example, the transmission identification fulfils a criterion determined by the processor. The processor can then change this criterion after each transmission or after a finite number of transmissions according to predetermined rules. In this case the same activation information is accepted as valid only a single time or a finite number of times. In addition, the activation information or a part of the activation information can be coded.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
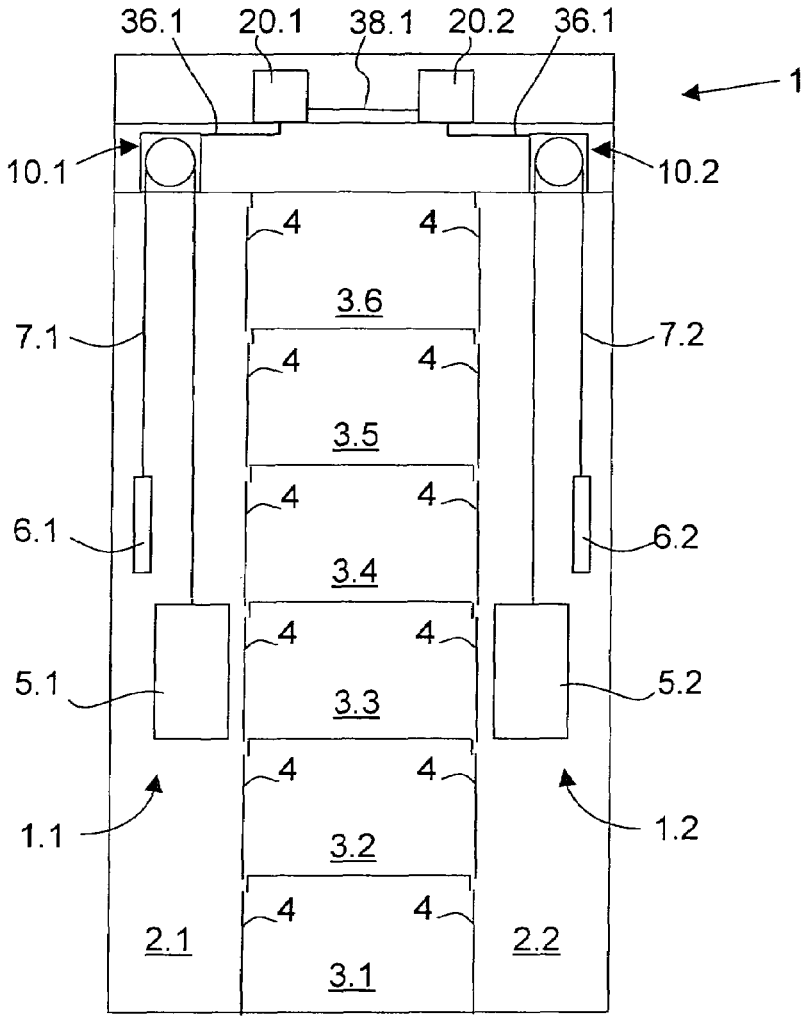
FIG. 1 is a schematic diagram of an elevator installation which comprises two elevators each with a respective elevator control according to the present invention.

FIG. 1 shows an elevator installation with two elevators 1.1 and 1.2 in a building with two shafts 2.1 and 2.2 and six floors 3.1 to 3.6. The elevators 1.1 and 1.2 each have a respective car 5.1 and 5.2. The shafts 2.1 and 2.2 are accessible from the floors 3.1 to 3.6 by way of an associated floor door 4.

The car 5.1 and a counterweight 6.1, which is connected with the car 5.1 by way of a support means 7.1, are movable in the shaft 2.1 by means of a drive 10.1 which is constructed as a traction drive acting on the support means 7.1. Correspondingly, the car 5.2 and a counterweight 6.2, which is connected with the car 5.2 by way of a support means 7.2, are movable in the shaft 2.2 by means of a drive 10.2 which is constructed as a traction drive acting on the support means 7.2. The elevators 1.1 and 1.2 are so designed that the floors 3.1 to 3.6 can be served by each of the cars 5.1 and 5.2.

Two elevator controls 20.1 and 20.2 are provided for controlling the elevator installation. The elevator control 20.1 serves for controlling the elevator 1.1 and the elevator control 20.2 serves for controlling the elevator 1.2.

The elevator 1.1 comprises a control connection 36.1, which produces a connection between the elevator control 20.1 and all conventional components of the elevator 1.1 which are to be controlled in operation, inter alia the drive 10.1, a door of the car 5.1 (not illustrated), the floor doors 4 at the shaft 2.1, input and indicating devices for car and/or floor calls (not illustrated), a device for lighting the car 5.1 (not illustrated), a device for lighting the floors 3.1 to 3.6 (not illustrated), a device for acoustic and/or visual reproduction of data (not illustrated) and sensors for monitoring the components and the operation of the elevator 1.1 (not illustrated).

Correspondingly, the elevator 1.1 comprises a control connection 36.1, which produces a connection between the elevator control 20.2 and all conventional components of the elevator 1.2 which are controlled in operation, inter alia the drive 10.2, a door of the car 5.2 (not illustrated), the floor doors 4 at the shaft 2.2, input and indicating devices for car and/or floor calls (not illustrated), a device for lighting the car 5.2 (not illustrated), a device for lighting the floors 3.1 to 3.6 (not illustrated), a device for acoustic and/or visual reproduction of data (not illustrated) and sensors for monitoring the components and the operation of the elevator 1.2 (not illustrated).

The elevators 1.1 and 1.2 are—respectively controlled by the elevator control 20.1 and the elevator control 20.2—operable independently of one another. The elevator installation 1, however, has—as an optional function—a group control which, when activated, can adapt the operation of the elevators 1.1 and 1.2 to one another in order to distribute the call requests for the different floors 3.1 to 3.6 in optimum manner to the two elevators 1.1 and 1.2 and thus enable a more rapid working down of various calls. In order to make this group control possible, the elevator controls 20.1 and 20.2 are connected together by way of a communications connection 38.1: the elevator controls 20.1 and 20.2 can appropriately co-ordinate the operation of the elevators 1.1 and 1.2 via a data exchange by way of the communications connection 38.1.

Figure 2:
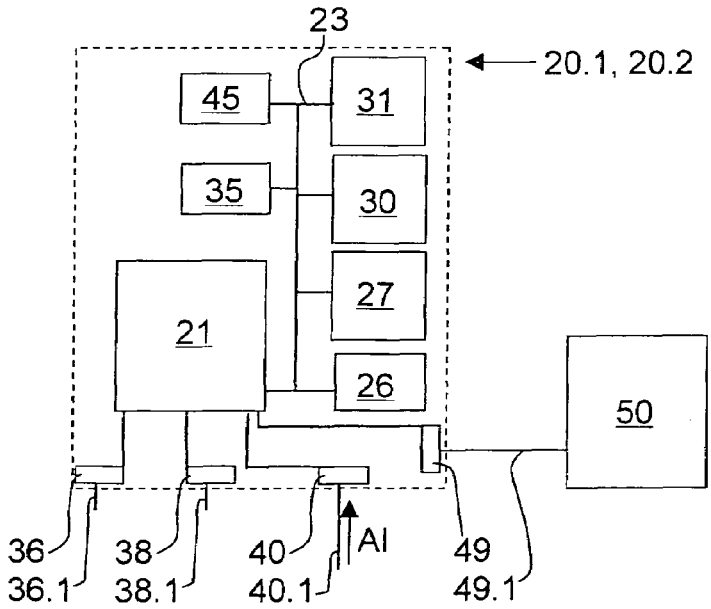
FIG. 2 is a block diagram of the elevator control according to FIG. 1.

As FIG. 2 shows, the elevator control 20.1 and 20.2 are of identical construction. The elevator controls 20.1 and 20.2 each comprises a respective processor 21, with which several components are connected by way of a connection 23 including:

a working memory 26;

a memory 27 for data with a program or programs for control of a elevator during operation of the elevator;

an electronic control system 30 which comprises function elements—for control of the elevator—in the form of hardware;

a memory 31, which comprises a library with program modules which contain program codes for control of the elevator and are optionally available at the time of configuring; and memories 35 and 45 serving for control of optional functions (as explained below).

The processor 21 is respectively connected with a series of interfaces including:

an interface 36 for exchange of control signals by way of the control connection 36.1;

an interface 38 for communication by way of the communications connection 38.1;

an interface 40 for communication by way of a communications connection 40.1; and an interface 49 for communication with a service and/or maintenance center 50 by way of a communications connection 49.1.

The electronic control system 30 and the memory 31 form (in the form of hardware and software) an implementation of the functions which can be available to the elevator control 20.1 or 20.2 for controlling the elevator 1.1 or 1.2 in operation. Which functions are actually available in operation for control of the elevators 1.1 and 1.2 is established by a configuring of the elevator controls 20.1 and 20.2.

Figure 3:
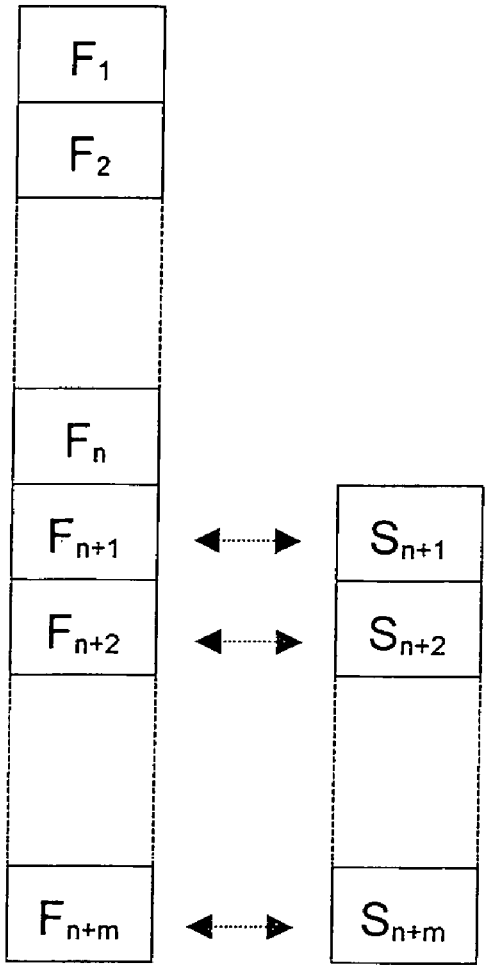
FIG. 3 is a schematic representation of implemented standard functions and optional functions and an example for checking the availability of optional functions for control during operation of the elevator installation according to FIG. 1.

The sequence of a configuring is explained by reference to FIG. 3. For this purpose it is assumed that "n+m" functions are implemented in the elevator control 20.1 or 20.2, wherein these functions in FIG. 3 are symbolically denoted by $F_1$, $F_2, \ldots, F_n, F_{n+1}, \ldots, F_{n+m}$ (wherein 1 is less than or equal to "n" and 1 is less than or equal to "m"). Each of these functions comprises one or more control commands which are transmissible by way of the respective control connection 36.1 for control of the elevators 1.1 and 1.2. Individual ones of these functions may refer back to other functions in the sense of sub-functions.

It is assumed that the functions $F_1$ to $F_n$ are standard functions and the functions $F_{n+1}$ to $F_{n+m}$ are optional functions. Consequently, no possibility of choice in the configuring of the elevator control 20.1 or 20.2 exists with respect to the functions $F_1$ to $F_n$: after each configuring, these functions are available for control of the elevators 1.1 and 1.2 in operation and are accordingly activated. With respect to the functions $F_{n+1}$ to $F_{n+m}$, possibilities of choice exist in configuring of the elevator controls 20.1 and 20.2: these functions are activatable in the case of need. In the configuring it is established which of the optional functions $F_{n+1}$ to $F_{n+m}$ shall be available for control of the elevators 1.1 and 1.2 in operation, i.e. shall be activated.

As a result of a configuring, appropriate status data $S_{n+1}$ to $S_{n+m}$ are generated for the optional functions $F_{n+1}$ to $F_{n+m}$ and are filed in the memory 35 of the elevator control 20.1 or 20.2 (see FIGS. 2 and 3). The status information $S_i$ (i>n) is associated with the optional function $F_i$, as indicated in FIG. 3 by double arrows. The status information $S_i$ provides—able to be called up for the processor 21 in operation—the following data with respect to the optional functions $F_i$:

a) information about whether one of the optional functions $F_i$ is activated;

b) if the function $F_i$ is activated: information about whether this function is to be activated and, if so, under which conditions or at which point in time; and c) in a given case, further parameters which serve for specification of the functions $F_i$.

The foregoing points a) to c) may be explained by way of example on the basis of an optional function of "individual handicapped-person mode". If this handicapped-person mode is activated, then it is provided in operation of the elevator installation 1 that a handicapped person can make themselves known at the elevator control 20.1 or 20.2 (according to a desired process implemented in the elevator control) with the result that all doors which the handicapped person has to pass for use of the elevator installation remain open for a period of time which is prolonged relative to a predetermined standard value and is appropriate for the handicapped person. In the present case the status information $S_i$, which is associated with this optional function of "individual handicapped-person mode" and is filed in the memory 35 at the time of configuring the elevator control 20.1 or 20.2, could have, for example, the following content: with respect to point a), it is established that the optional function "individual handicapped-person mode" is activated, i.e. shall be available in operation of the elevator installation 1 after the configuring; with respect to point b), it is, for example, established that this optional function shall be deactivated after expiry of a specific period of time in conjunction with the configuring of the elevator control 20.1 or 20.2 and thus no longer be available in operation of the elevator installation 1; with respect to point c), there is stored, for example, a list of handicapped persons which shall be identifiable by the elevator control and, for each identifiable person, a value for the respective duration of door opening.

As further optional functions which are activatable at the time of configuring and deactivatable at a later point in time, there are provided for example:

(i) a function "detection and/or diagnosis of operational data" (this function can comprise a detection and diagnosis of operational data, which an additional use brings relative to operational data which has to be provided due to legal determinations or standards in any case by every elevator control; for example, this function can comprise, as an option, detection of all switching processes of electrical components, a statistical diagnosis of these switching processes and storage of results of this diagnosis, or the like);

(ii) a function "detection and/or processing of maintenance data" (this function can determine, for example, data with regard to the operational life of individual components, determine the point in time of the last maintenance for selected components and deliver warnings with respect to maintenance which is due);

(iii) a function "setting up a fault log" (this function can, for example, establish occurring faults in operation of the elevator installation and ascertain for each fault a fault code which enables a detailed analysis of the causes for the occurrence of the fault; in addition, fault codes can be stored over a specific period of time and different faults can be brought into correlation with one another);

(iv) a function "freeing of a communications interface for data communication with the elevator control";

(v) a function "automatic switching-on/switching-off lighting of a elevator car" (this function allows control of lighting in an elevator car in dependence on the presence of persons);

(vi) a function "automatic switching-on/switching-off lighting at a floor" (this function allows control of lighting at a floor in dependence on the presence of persons);

(vii) a function "control of a device for acoustic and/or visual reproduction of data";

(viii) a function "control of a device for presenting multimedia material";

(ix) a function "monitoring of an interior space of a car";

(x) a function "monitoring of a lobby at a floor door";

(xi) a function "indication of a position of a car at predetermined floors";

(xii) a function "automatic return of a car to a predetermined floor";

(xiii) a function "early opening of car and/or floor doors before stopping of the car at a floor";

(xiv) a function "recognition of improper car calls"; and (xv) a function "group control for a group of elevators".

A method of configuring the elevator control 20.1 or 20.2 is explained in the following.

A configuring of the elevator control 20.1 or 20.2 can be undertaken by transmitting an activation information A1 to the elevator control 20.1 or 20.2 (see FIG. 2). The activation information A1 consists of a sequence of signals, which can be communicated by way of the communications connection 40.1 and the interface 40 or by way of the connections connection 49.1 and the interface 49 to the processor 21 and evaluated by the processor 21.

For communication of the activation information A1, the communications connection 40.1 or 49.1 and the interface 40 or 49 there are number of suitable possibilities of realization on the basis of known technologies. The invention is not restricted to a specific possibility of realization.

The activation information A1 can, for example, consist of digital data or analog signals. Any means for transmission of data or signals is suitable as communications connection 40.1 or 49.1. Correspondingly, any means which makes the data or the signals accessible to the processor 21 in a form suitable for further processing is suitable as interface 40 or 49. The communications connection 40.1 or 49.1 can be based on, for example, the transmission of electrical or optical signals, wherein the transmission of the signals can take place by way of lines or also without being confined to lines (wire-free manner). A number of technical means are suitable for generating the activation information A1. The activation information A1 can be produced by means of a keyboard connected with the interface 40, for example by means of a keyboard which forms a fixed constituent of the control 20.1 or 20.2. Alternatively, the activation information could also be generated by a mobile computer and be transmitted to the interface 40. As a further alternative it would be conceivable to produce the activation information A1 at a remote location, for example in a service center or the service and/or maintenance center 50, and transmit it to the processor 21 for further processing. It is also possible for the activation information to be supplied in the form of data, which is stored on a data carrier, and for the data to have to be read from the data carrier (for example a memory card with a memory chip). In this case the interface 40 can also be constructed as a device for reading the data.

The activation information A1 communicated to the processor 21 is evaluated by the processor 21 in accordance with an evaluation criterion by an evaluation program, which is stored in the memory 45. The evaluation comprises:

if the activation information A1 is coded, a corresponding decoding;

a checking of the activation information A1 with respect to validity in accordance with a predetermined criterion; and if the step "checking of the activation information A1 with respect to validity" gives the result that the activation information satisfies the predetermined criterion, conversion of the activation information A1 into data required for configuring the elevator control 20.1 or 20.2.

The step "checking the activation information A1 with respect to validity" enables the processor 21 to check whether configuring of the elevator control 20.1 or 20.2 and activation of the optional functions $F_{n+1}$ to $F_{n+m}$ shall be undertaken or prevented. Details of a check of that kind are explained in the following.

Figure 4:
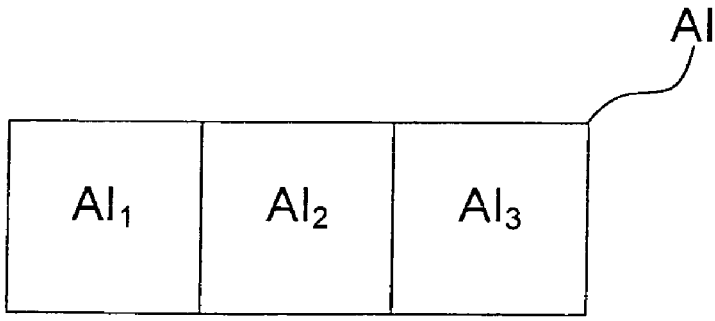
FIG. 4 is a schematic representation of an example for an activation information according to the present invention.

It is assumed that the activation information A1 which is evaluated by the processor 21 as valid is composed of three components $A1_1$, $A1_2$ and $A1_3$ as indicated in FIG. 4.

If the activation information A1 consists of, for example, a sequence of digital data, then A1 could consist of three successive data sets, each of which is represented by a respective one of $A1_1$, $A1_2$ and $A1_3$. It is a task of the processor 21 to suitably evaluate the activation information A1 and separate the components $A1_1$, $A1_2$ and $A1_3$.

The activation information A1 is checked with respect to validity by means of the evaluating program as follows:

The component $A1_1$ contains data or a code for identification of the elevator control which is to be configured. The activation information is recognized as invalid if this data or this code do not agree or does not agree with corresponding data or a corresponding code for the elevator control 20.1 or 20.2 which is present.

The component $A1_2$ contains data or a code for checking whether the communication of the activation information A1 by unauthorized persons was carried out, i.e. represents an obvious misuse. A1 is classified as valid by the evaluating program only if $A1_2$ fulfils at least one or more of the following conditions (i) to (ii): (i) $A1_2$ contains a characterization, which is known to the evaluating program, of a person who is to be authorized for communication of activation information and/or (ii) $A1_2$ contains a characterization, which is known to the evaluating program, of a contract which grants the right to undertake configuring of the elevator control 20.1 or 20.2 and/or (iii) $A1_2$ contains a valid communications identification, i.e. a characterization which is identical only for a single transmission or finitely a plurality of transmissions of activation information A1 to the processor 21. The respectively valid communication identification according to point (iii) can be changed in accordance with a predetermined method under the control of the processor 21 or the evaluating program, for example in conjunction with a successfully concluded configuring. The communication identification can be, for example, a sequence of several characters. The evaluating program checks the communicated activated information A1 on the basis of the points (i) to (iii) and classifies A1 as valid or invalid depending on the result of the check.

The component $A1_3$ contains data which establishes an activation and/or deactivation of the optional functions $F_{n+1}$ to $F_{n+m}$. $A1_3$ comprises the information which of the optional functions $F_{n+1}$ to $F_{n+m}$ shall be activated in the configuring and the information under which conditions one of the activated optional functions shall be deactivated at a later point in time. The activation information A1 is regarded as valid when $A1_3$ uniquely specifies the optional functions to be activated.

A configuring of the elevator control 1.1 or 1.2 can be undertaken in accordance with the following steps:

A valid activation information A1 is communicated to the processor 21.

After verification of the validity of the activation information A1 according to the above-described method, there are ascertained from the group of optional functions $F_{n+1}$ to $F_{n+m}$ those functions which are to be activated according to the component $A1_3$. The corresponding status data $S_{n+1}$ to $S_{n+m}$ are determined by the processor 21 and filed in the memory 35.

After configuring of the elevator controls 20.1 and 20.2, operation of the elevator installation 1 can be undertaken.

In operation of the elevator installation 1 the elevator 1.1 is controlled according to a program P1 filed in the memory 27 of the elevator control 20.1. Correspondingly, the elevator 1.2 is controlled according to a program P2 filed in the memory 27 of the elevator control 20.2. The programs P1 and P2 have access to the memory 35 of the respective elevator control 20.1 or 20.2 and, in particular, to the status data $S_{n+1}$ to $S_{n+m}$. The status data $S_{n+1}$ to $S_{n+m}$ supply to the program P1 or P2 the data which of the optional functions $F_{n+1}$ to $F_{n+m}$ make available additionally to the standard functions $F_1$ to $F_n$, for control of the elevators 1.1 and 1.2 in operation. The status data $S_{n+1}$ to $S_{n+m}$ additionally supply to the program P1 or P2—if necessary—for each activated optional function $F_i$ (i>n) further parameters which are specific to operation of the elevator 1.1 or 1.2 and are required for establishing all control steps which the function $F_i$ embraces. On the basis of the status data $S_{n+1}$ to $S_{n+m}$ the program P1 or P2 has access to the optional functions $F_{n+1}$ to $F_{n+m}$ and can use these in operation for control of the elevator 1.1 or 1.2 as long as they are activated.

Should the optional function "group control function for a group of elevators" (above function under (xv)) then this optional function in operation ensures a coordinated rundown of the programs P1 and P2 for control of the elevators 1.1 and 1.2.

The processor 21 of the elevator control 20.1 controls, in operation, the status data $S_{n+1}$ to $S_{n+m}$ which are filed in the memory 35 of the elevator control 20.1 and ascertains from the status data whether one of the conditions, which is established in the status data $S_{n+1}$ to $S_{n+m}$, for deactivation of one of the activated optional functions is fulfilled. If, for an activated optional function $F_i$ (i>n) according to the corresponding status information $S_i$, the point in time for deactivation of $F_i$ has been reached, then the optional function $F_i$ is deactivated. For this purpose the status information $S_i$ is suitably changed, for example deleted in the memory 35 of the elevator control 20.1. From now on the deactivation of the optional function $F_i$ is effective for the program P1: $F_i$ is no longer available for the elevator control 20.1 for controlling the elevator 1.1 in operation. The processor 21 and the memory 35 accordingly together form a device which causes or controls automatic deactivation of the optional function $F_i$.

The processor 21 of the elevator control 20.2 correspondingly controls, in operation, the status data $S_{n+1}$ to $S_{n+m}$ filed in the memory 35 of the elevator control 20.2 and ascertains whether one of the conditions, which are established in the status data $S_{n+1}$ to $S_{n+m}$, for deactivation of one of the activated optional functions is fulfilled. If for an activated optional function $F_i$ (i>n) according to the corresponding status information $S_i$ the point in time for deactivation of $F_i$ has been reached, then the optional function $F_i$ is deactivated. For this purpose the status information $S_i$ is suitably changed, for example deleted in the memory 35 of the elevator control 20.2. From now on the deactivation of the optional function $F_i$ is effective for the program P2: $F_i$ is no longer available for the elevator control 20.2 for controlling of the elevator 1.2 in operation. The processor 21 and the memory 35 accordingly together form a device causes or controls automatic deactivation of the optional function $F_i$.

In order to determine the point in time for deactivation of an optional function $F_k$ (k>n), the processor 21 of the elevator control 20.1 or 20.2 can execute each time different forms of controls. The status information $S_k$ can, for example, establish that a deactivation of $F_k$ is to take place after expiry of a predetermined time period. In the case of specific optional functions it can, however, be decisive for deactivation how frequently a specific event in operation of the elevators 1.1 and 1.2 has occurred. In this case the status information $S_k$ comprises information about which event has to be monitored by the processor 21 and how often the event may occur before the function is automatically deactivated. In this case the processor ascertains a frequency of the event predetermined in that manner and arranges for deactivation of $F_k$ when the frequency of the event reaches a predetermined degree. An example for the last-mentioned case is represented by the optional function "early opening of car and/or floor doors before stopping of the car at a floor" (above function under (xiii)). This function produces an acceleration of the operation, since the doors are opened a defined period of time before stopping of a car at a floor and thus a precondition is created for reducing waiting time of the car at the floor. However, activation of this function is connected with risks if the doors exhibit wear phenomena after frequent use and the optional function "early opening of car and/or floor doors before stopping of the car at a floor" can no longer be executed with the requisite precision. In this case it can be provided that the processor 21 ascertains the number of door openings executed in operation and deactivates the function "early opening of car and/or floor doors" when the number reaches a predetermined level. Subsequently, the doors are actuated in accordance with a standard function "normal opening of car and/or floor doors". In this connection the doors are opened only when the car has come to a stop at a floor. Through this measure merely operation of the elevator is slowed down.

As an additional service it is provided that the elevator control 20.1 or 20.2 supplies at least one reference to imminent deactivation of an optional function. An approach to deactivation can be indicated at the appropriate time at an information display of the elevator control 20.1 or 20.2. Alternatively, such a reference can be transmitted to a service center 50. In order to enable a transmission of that kind, the interface 49 is provided, which is provided for a communication with the service and/or maintenance center 50 by way of the communications connection 49.1.

Activation of an optional function can be repeated at a later point in time. For this purpose, an activation information A1 can be transmitted again by way of the interface 40 to the processor 21 of the elevator control 20.1 or 20.2. A fresh configuring of the elevator control 20.1 or 20.2 then takes place in correspondence with this activation information A1. In that connection it is to be noted that the evaluation program might request a changed communication identification in the component $A1_2$ of the activation information in order to accept the activation information A1 as valid, even when the remaining parts of the activation information agree with corresponding activation information successfully used on one occasion at an earlier point in time for configuring the elevator control 20.1 or 20.2. In this way the risk is reduced that a specific activation information can be used by an unauthorized person repeatedly for configuring the elevator controls 20.1 and 20.2 and thus for renewed activation of a previously deactivated optional function.

If after activation of an optional function $F_i$ there is a wish to change the criterion for deactivation of the function $F_i$, for example in order to extend or shorten the time period in which the function $F_i$ is activated, then the criterion for deactivation of the function $F_i$ can be suitably adapted by renewed communication of an activation information A1. The status information $S_i$ for the function $F_i$ is then correspondingly changed in the memory 35. The processor 21 then causes deactivation of $F_i$ in correspondence with the changed status $S_i$.

The described method and devices can obviously be modified in many ways within the scope of the invention.

For example, the memories 26, 27, 31, 35 and 45 do not necessarily have to be realized on separate storage media. The data associated with the mentioned memories can also take up regions on a single storage medium or several suitable storage media (for example, hard discs, EPROM, etc.) and be run by the processor 21 on the respective storage medium.

The activation and deactivation of the optional functions $F_{n+1}$ to $F_{n+m}$ can also take place according to alternative methods. For example, an optional function $F_i$ in the form of a program module can be implemented, which is filed in, for example, the memory 31. For activation of the function $F_i$, for example, a program code could be loaded into another storage region, for example into the memory 27, and be linked with the program P1 or P2 filed in the memory 27 in such a manner that the program code for the program P1 or P2 is available for control of the elevator 1.1 or 1.2. For deactivation of the optional function $F_i$ the link between the program code and the program P1 or P2 could be cancelled and, in a given case, the program code in the memory 27 could be deleted again. The program code is subsequently no longer available for the program P1 or P2 for controlling in operation.

The elevator control 20.1 or 20.2 has in the present case a processor 21 which controls a plurality of processes. Alternatively, the elevator control 20.1 or 20.2 could be equipped with several processors. For example, a first processor could be provided which evaluates the incident activation data and controls activation or deactivation of the optional functions. This processor would accordingly control configuring of the elevator control 20.1 or 20.2. A second processor could be responsible exclusively for control of the elevator 1.1 or 1.2 in operation. It could control the run-down of the program P1 or P2 and, for fulfillment of this task, have access to all standard functions and optional functions which are instantaneously activated for operation of the elevator installation.

In order to realize a group control for several elevators of a elevator installation, a third processor could optionally be provided which is specific to control of group control processes. Whereas each elevator of the elevator installation can have an own elevator control, the third processor can distribute the entire traffic volume of the elevator installation to the individual elevators according to a suitable method and for this purpose communicate with the elevator controls of the individual elevators in order to achieve co-ordination of the processes controlled by the elevator controls of the individual elevators.

In addition, it could be provided that the elevator control 20.1 or 20.2 could be connected with a device which comprises implementation of additional optional functions for control of an elevator. Individual ones of these additional optional functions could be activated in the case of a further configuring of the elevator control 20.1 or 20.2. In this way the scope of the function of the elevator control 20.1 or 20.2 can be subsequently enlarged. A device of that kind could also be integrated in the elevator control (for example, in the form of a plug card and/or a memory card) or be connected with the elevator control 20.1 or 20.2 by way of a suitable communications interface in such a manner that the additional optional functions are accessible for the elevator control 20.1 or 20.2.

In the aforesaid cases the device which contains the additional optional functions and the elevator control 20.1 or 20.2 could be constructed in such a manner that the device merely has to be connected with the elevator control 20.1 or 20.2 by way of a suitable interface and the elevator control subsequently automatically recognizes the connection with the device, for example in operation of the elevator installation or after switching-on of the elevator control. The elevator control 20.1 or 20.2 can be so constructed that it automatically recognizes the change, which is undertaken in this manner, in the configuration of the elevator control, for example according to the "plug-in-and-play" principle known from the computer field, and automatically undertakes reconfiguring of the elevator control in which the additional optional functions are activated, i.e. are made available for control of the elevator installation in operation. The aforesaid device can—for example, in a memory—keep available activation information which can be evaluated by the elevator control and comprises all necessary data required for activation of the additional optional functions (for example, with respect to identification of the optional functions to be activated and the respective instant in time of the activation or deactivation of the optional functions). Alternatively, it can be provided that the aforesaid device itself contains a control device able to ensure deactivation of the optional functions, which are implemented in the device, according to a predetermined criterion (in the sense of the present invention).

FIG. 3 specifies an activation information A1 with three components $A1_1$, $A1_2$ and $A1_3$. It may be mentioned that an activation information specified in that manner is merely one specific example for activation information. The components $A1_1$ and $A1_2$ do not contain any information about the optional functions which are to be activated or deactivated and merely form special safety features which render difficult improper use of the activation information A1. The invention can also be realized without safety features of that kind.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of operating an elevator installation having an elevator control for controlling the elevator installation, wherein the method comprises the steps of:

a) implementing a plurality of functions for controlling the operation of the elevator installation into the elevator control, which implementation is accomplished by a provider of the elevator control, and whereby at least one optional function is implemented into the elevator control by the provider, which at least one optional function is activatable at a time of configuring the elevator control and by activation can be made available for control during the operation of the elevator installation;

b) configuring the elevator control according to the requirements of the operator of the elevator installation, whereby the at least one optional function is activated;

c) starting and operating the elevation installation; and d) deactivating the at least one optional function automatically at an instant in time during the operation, wherein the at least one optional function is available for multiple uses prior to deactivation and after the deactivation the at least one optional function is no longer available for control of the elevator installation in operation.

2. The method according to claim 1, wherein the instant in time of performing said step d) by the elevator control is instigated in accordance with a predetermined criterion.

3. The method according to claim 1, wherein performing said step d) is instigated in response to at least one of i) expiry of a predetermined time period, ii) a frequency of a predetermined event reaches a predetermined degree, and iii) status information.

4. The method according to claim 1 including generating at least one reference to imminent deactivation of the at least one optional function by the elevator control.

5. The method according to claim 1 including generating at least one reference to imminent deactivation of the at least one optional function by the elevator control and communicating the at least one reference to at least to one of i) a service center, ii) a maintenance center, iii) a service and maintenance center, iv) a display, and v) a loudspeaker of the elevator control.

6. The method according to claim 1 wherein the at least one optional function is one of detection and/or diagnosis of operational data, detection and/or processing of maintenance data, creation of a fault log, freeing of a communications interface for a data communication with the elevator control, automatic switching-on/switching-off lighting of an elevator car of the elevator installation, automatic switching-on/switching-off lighting at a floor of the elevator installation, control of a device for acoustic and/or visual reproduction of information, control of a device for presenting multimedia material, monitoring an interior space of the elevator car, monitoring a lobby at a floor door of the elevator installation, indication of a position of the car at predetermined floors of the elevator installation, automatic return of the car to a predetermined floor of the elevator installation, early opening of the car and/or floor doors ahead of stopping of the car at a floor of the elevator installation, recognition of improper car calls, and a group control for a group of elevators of the elevator installation.

7. A method of operating an elevator installation having an elevator control for controlling the elevator installation, wherein the method comprises the steps of:

a) implementing several standard functions and several optional functions for controlling the operation of the elevator installation into the elevator control, which implementation is accomplished by a provider of the elevator control, and whereby at least one of the optional functions is activatable at a time of configuring the elevator control and by activation can be made available for control during the operation of the elevator installation;

b) configuring the elevator control according to the requirements of the operator of the elevator installation whereby the at least one optional function is activated during the configuration in a way that it is available for the control initially from the start of the operation of the elevator installation and the at Least one optional function is activated in dependence on a predetermined parameter;

c) starting and operating the elevation installation; and d) deactivating the at least one optional function during operation automatically, wherein the at least one optional function is available for multiple uses prior to deactivation and after the deactivation the at least one optional function is no longer available for control of the elevator installation in operation.

8. The method according to claim 7, wherein an instant in time of performing said step d) by the elevator control is instigated in accordance with a predetermined criterion.

9. The method according to claim 7, wherein performing said step d) is instigated in response to at least one of i) expiry of a predetermined time period, ii) a frequency of a predetermined event reaches a predetermined degree, and iii) status information.

10. The method according to claim 7 including generating at least one reference to imminent deactivation of the at least one optional function by the elevator control.

11. The method according to claim 7 including generating at least one reference to imminent deactivation of the at least one optional function by the elevator control and communicating the at least one reference to at least one of i) a service center, ii) a maintenance center, iii) a service and maintenance center, and iv) a display of the elevator control.

12. The method according to claim 7 wherein the predetermined parameter is one of: a) a predetermined time of operation; b) a frequently occurring event which has been occurred a predetermined number of times; c) a function "open car and/or shaft doors" is rendered more precisely by how quickly the doors are to be opened or closed and/or how long doors are to be open; d) a definition which optional functions has to be executed simultaneously or in succession in a specific sequence in time; e) a rule forte handling of calls; and f) definition for different operator modi including: (i) pushbutton control, (ii) collective downward control, and (iii) collective/selective control or group control.

13. The method according to claim 7 wherein the predetermined parameter is the receiving of an activation information by way of an interface of the elevator control and wherein the method comprises the steps of: processing the received activation information and executing the related optional function accordingly for controlling the elevator installation.

14. The method according to claim 7 wherein the predetermined parameter is the receiving of an activation information by way of an interface of the elevator control and wherein the method comprises the steps of: checking the received activation information for a security information; checking the security information for validity; and in case of a valid security information within the activation information executing the related optional function for controlling the elevator installation.

15. The method according to claim 7 wherein the predetermined parameter is the receiving of an activation information by way of an interface of the elevator control and wherein the method comprises the steps of: checking the received activation information for encoded information; in case of encoded information, decoding the encoded information; checking the whole received and prepared activation information for a security information; in case of the presence of a security information verifying the validity of the security information; and in case of a valid security information within the activation information executing the related at least one optional function for controlling the elevator installation.

16. The method according to claim 7 wherein the predetermined parameter is the receiving of an activation information by way of an interface of the elevator control and the execution of the related optional function a predetermined number of times, wherein the method comprises the steps of: processing the received activation information; wherein the activation information is checked whether it fulfills a predetermined criterion, and in case it does, executing the related optional function; and after the predetermined number of times of receiving said activation information modifying subsequently said predetermined criterion in such a manner that the activation is not undertaken a further time if the same activation information is communicated by way of the interface of the elevator control.

17. The method according to claim 16 wherein the provided activation information is stored on a data carrier and the method includes a step of reading and investigating the data with respect to validity.

18. The method according to claim 7 wherein the at least one optional function is one of a) detection and/or diagnosis of operational data, b) detection and/or processing of maintenance data, c) creation of a fault log, d) freeing of a communications interface for a data communication with the elevator control, e) automatic switching-on/switching-off lighting of an elevator car of the elevator installation, f) automatic switching-on/switching-off lighting at a floor of the elevator installation, g) control of a device for acoustic and/or visual reproduction of information, h) control of a device for presenting multimedia material, i) monitoring an interior space of the elevator car, k) monitoring a lobby at a floor door of the elevator installation, l) indication of a position of the car at predetermined floors of the elevator installation, m) automatic return of the car to a predetermined floor of the elevator installation, n) early opening of the car and/or floor doors ahead of stopping of the car at a floor of the elevator installation, o) recognition of improper car calls, p) group control for a group of elevators of the elevator installation.

19. The method according to claim 7 wherein for activation of the at least one optional function a program code is loaded into a memory of the elevator control and for deactivation of the at least one optional function the program code is deleted from said memory.

20. The method according to claim 7 wherein for activation of the at least one optional function a status data is generated for the related optional function and filed in a memory for status data provided in the elevator control and for deactivation of the at least one optional function the according status data is modified or deleted from said memory, thus the related optional function is no longer available for controlling the operation of the elevator installation.

21. The method according to claim 20 wherein the status data of an optional function provides at least one of the following information when it is called up by a processor of the elevator control: a) whether the optional function is activated or not; b) in case the optional functions activated: information about whether this function has to be executed and, if so, under which conditions or at which point in time; and c) further parameters which serve specification of the optional function.

22. An elevator control comprising a plurality of functions for controlling an elevator installation, which functions are implemented by the provider of the elevator control and comprising software or software and hardware, and which functions are distinguished in standard functions always available for controlling the elevator installation and optional functions available for controlling the elevator installation after an activation;

a means for storing at least one optional function which is selected from the implemented optional functions during configuration of the elevator control and which is activated during configuration to be initially available for controlling the elevator installation and which can be made available for control by an activation during operation of the elevator installation; and a means for automatic deactivation of the at least one optional function wherein the at least one optional function is available for multiple uses prior to deactivation and after its deactivation making the at least one optional function no longer available for control during operation of the elevator installation.

23. The elevator control according to claim 22, wherein the means for automatic deactivation comprises a processor and a memory for storing status data related to optional functions.

24. The elevator control according to claim 22 including an interface for receiving communication of activation information for control of the activation and/or the deactivation of the at least one optional function.

25. The elevator control according to claim 22 including an interface for receiving communication of activation information and means for evaluation of the activation information and means for executing the activation and/or deactivation of the at least one optional function in dependence on a result of the evaluation.

26. The elevator control according to claim 25 wherein the means for evaluation is a processor.

27. The elevator control according to claim 22 including means for decoding encoded information of an activation information if necessary.

28. The elevator control according to claim 22 including means for checking activation information with respect to the validity of optionally included security information of the activation information in accordance with a predetermined criterion.

29. The elevator control according to claim 22 including a memory for storing status information with respect to the activation or deactivation of the at least one optional function.

30. The elevator control according to claim 22 comprising a processor and a connection, which connection connects the processor with at least one of several components of the elevator control including:

a) a working memory;

b) a memory for data with a program or programs for control of an elevator during operation of the elevator;

c) an electronic control system which comprises function elements for control of the elevator in the form of hardware;

d) a memory, which comprises a library with program modules which contain program codes for control of the elevator and are optionally available at the time of configuring;

e) a memory for storing status data related to optional functions; and f) a memory for data serving for control of optional functions.

31. An elevator installation comprising at least a car and a counterweight, which is connected with the car by way of a support means, movable in the shaft by means of a drive which is constructed as a traction drive acting on the support means designed to serve several floors in a building and an elevator control provided for controlling the operation of the elevator installation, wherein the elevator control comprises:

a plurality of functions for controlling an elevator installation, which functions are implemented by the provider of the elevator control and comprising software or software and hardware, and which functions are distinguished in standard functions always available for controlling the elevator installation and optional functions available for controlling the elevator installation after an activation;

a means for storing at least one optional function which is selected from the implemented optional functions during configuration of the elevator control and which is activated during configuration to be initially available for controlling the elevator installation or which can be made available for control by an activation during operation of the elevator installation; and a means for automatic deactivation of the at least one optional function wherein the at least one optional function is available for multiple uses prior to deactivation and after its deactivation making the at least one optional function no longer available for control during operation of the elevator installation.

32. The elevator installation according to claim 31 wherein the elevator control has a processor and a connection, which connection connects the processor with at least one of several components of the elevator control including:

a) a working memory;

b) a memory for data with a program or programs for control of an elevator during operation of the elevator;

c) an electronic control system which comprises function elements for control of the elevator in the form of hardware;

d) a memory, which comprises a library with program modules which contain program codes for control of the elevator and are optionally available at the time of configuring;

e) a memory for storing status data related to optional functions; and f) a memory for data serving for control of optional functions.

33. The elevator installation according to claim 31 wherein the elevator control has a processor and a connection, which connection connects the processor with at least one of several components of the elevator control including:

a) a working memory;

b) a memory for data with a program or programs for control of an elevator during operation of the elevator;

c) an electronic control system which comprises function elements for control of the elevator in the form of hardware;

d) a memory, which comprises a library with program modules which contain program codes for control of the elevator and are optionally available at the time of configuring;

e) a memory for storing status data related to optional functions;

f) a memory for data serving for control of optional functions; and g) wherein the processor is respectively connected with a series of interfaces including:

h) an interface for exchange of control signals by way of control connection to conventional components of the elevator;

i) an interface for communication by way of a communications connection in order to achieve activation information or activation information and operation instructions; and optionally j) an interface for communication with a service and/or maintenance center by way of a communications connection.

34. An elevator installation comprising at least two elevators having each a shaft with a car and a counterweight connected to each other by way of a support means, movable in the respective shaft by means of a drive which is constructed as a traction drive acting on the support means, each designed to serve several floors in a building and each of the elevators having an elevator control provided for controlling the operation of the respective elevator or for controlling the operation of the respective elevator and the elevator installation, wherein at least one of the elevator controls comprises:

a plurality of functions for controlling the elevator installation, which functions are implemented by the provider of the elevator control and comprising software or software and hardware, and which functions are distinguished in standard functions always available for controlling the elevator installation and optional functions available for controlling the elevator installation after an activation;

a means for storing at least one optional function which is selected from the implemented optional functions during configuration of the elevator control and which is activated during configuration to be initially available for controlling the elevator installation or which can be made available for control by an activation during operation of the elevator installation; and a means for automatic deactivation of the at least one optional function wherein the at least one optional function is available for multiple uses prior to deactivation and after its deactivation making the at least one optional function no longer available for control during operation of the elevator installation.

35. The elevator installation according to claim 34 wherein the at least one elevator control has a processor and a connecting, which connecting connects the processor with at least one of several components of the elevator control including:

a) a working memory;

b) a memory for data with a program or programs for control of a elevator during operation of the elevator;

c) an electronic control system which comprises function elements for control of the elevator in the form of hardware;

d) a memory, which comprises a library with program modules which contain program codes for control of the elevator and are optionally available at the time of configuring;

e) a memory for storing status data related to optional functions; and f) a memory for data serving for control of optional functions.

36. The elevator installation according to claim 34 wherein the at least one elevator control has a processor and a connecting, which connecting connects the processor with at least one of several components of the elevator control including:

a) a working memory;

b) a memory for data with a program or programs for control of a elevator during operation of the elevator;

c) an electronic control system which comprises function elements for control of the elevator in the form of hardware;

d) a memory, which comprises a library with program modules which contain program codes for control of the elevator and are optionally available at the time of configuring;

e) a memory for storing status data related to optional functions;

f) a memory for data serving for control of optional functions; and g) wherein the processor is respectively connected with a series of interfaces including:

h) an interface for exchange of control signals by way of control connection to conventional components of the elevator;

i) an interface for communication between at least two of the at least two elevator controls in order to coordinate the operation of the elevators by means of data exchange by way of communications connection;

j) an interface for communication by way of a communications connection in order to able to achieve external activation information; and optionally k) an interface for communication with a service and/or maintenance center by way of a communications connection.

* * * * *